United States Patent [19]

Seki

[11] Patent Number: 4,650,104

[45] Date of Patent: Mar. 17, 1987

[54] POSITIONING DEVICE FOR BUTTON SETTING MACHINES

[75] Inventor: Fumio Seki, Toyama, Japan

[73] Assignee: Nippon Notion Kogyo Co., Ltd., Tokyo, Japan

[21] Appl. No.: 660,117

[22] Filed: Oct. 12, 1984

[30] Foreign Application Priority Data

Oct. 13, 1983 [JP] Japan ..... 58-158470[U]

[51] Int. Cl.[4] ..... A41H 37/04; A41H 43/02

[52] U.S. Cl. ..... 227/99; 112/75; 269/304; 227/4; 227/100; 227/154; 33/190

[58] Field of Search ..... 227/4, 43, 154, 99, 227/100; 269/55, 56, 70, 292, 297, 303–305, 315; 112/65, 75, 108, 110; 33/190

[56] References Cited

U.S. PATENT DOCUMENTS

| | | | |
|---|---|---|---|
| 2,479,648 | 8/1949 | Swartz | 112/75 |
| 2,495,438 | 1/1950 | Bentley et al. | 269/70 |
| 2,526,851 | 10/1950 | Christensen | 269/315 |
| 2,830,476 | 4/1958 | Zapf | 269/70 X |
| 2,880,632 | 4/1959 | Charlat | 269/70 |
| 3,125,046 | 3/1964 | Pederson | 112/110 |
| 3,313,255 | 4/1967 | Rausch, Jr. et al. | 112/65 X |
| 3,639,071 | 2/1972 | Breitkopf et al. | 269/56 X |
| 3,848,495 | 11/1974 | Youra | 269/297 X |
| 3,939,542 | 2/1976 | Reggi | 227/136 X |

FOREIGN PATENT DOCUMENTS

| | | | |
|---|---|---|---|
| 0019480 | 3/1930 | Australia | 227/154 |
| 1299598 | 6/1962 | France | 112/75 |

*Primary Examiner*—Mark Rosenbaum
*Assistant Examiner*—Taylor J. Ross
*Attorney, Agent, or Firm*—Hill, Van Santen, Steadman & Simpson

[57] ABSTRACT

A positioning device comprises a reciprocably movable support table having a surface extending in a plane above a clinching die of a button setting machine for supporting a garment fabric to which a button is to be attached, and a pair of guide members disposed on the surface in perpendicular relation. The table includes a recess which is registry with the clinching die when the table is in an advanced position. One of the guide member is positionally adjustable in a direction perpendicular to the direction of movement of the table and the other guide member is positionally adjustable in a direction parallel to the direction of movement of the table. Thus the garment fabric can be positioned accurately and easily with respect to the clinching die by simply putting two adjacent edges of the garment fabric into guided engagement with the respective guide members. The positioning device may include a stopper mechanism for limiting reciprocation of the table at the advanced position and at a retracted position remote from the clinching die.

5 Claims, 7 Drawing Figures

POSITIONING DEVICE FOR BUTTON SETTING MACHINES

BACKGROUND OF THE INVENTION

1. Field of the Invention:

The present invention relates to a device for positioning a garment fabric with respect to a clinching die of a button setting machine.

2. Prior Art:

There are known various button setting machines generally including a punch and a die coacting together to clinch a button body and a tack with a garment fabric sandwiched therebetween, and an indicator for designating a position of the die with which a predetermined portion of the garment fabric is to be registered. The indicator comprises a slender rod or needle reciprocably movable, in timed relation to the movement of the punch, into and out of a position where a downwardly bent end of the needle is held in registry with the die. The bent end of the needle must be spaced a considerable distance from the die so as not to damage the garment fabric during reciprocation of the needle and the setting operation of the garment fabric onto the die. The needle indicator thus arranged has a significant drawback in that visual positioning operation would require highly experienced dexterity on the part of an operator. Due to the reliance on eye measurement, another drawback is that positioning operation would be rendered time consuming and precise attachement of the button to the garment could not be expected.

SUMMARY OF THE INVENTION

According to the present invention, there is provided a positioning device comprising a reciprocably movable support table having a surface extending in a plane above a clinching die of a button setting machine for supporting a garment fabric to which a button is to be attached, and a pair of guide mambers disposed on the surface in perpendicular relation. The table includes a recess which is in registry with the clinching die when the table is in an advanced position. One of the guide members is positionally adjustable in a direction perpendicular to the direction of movement of the table and the other guide member is positionally adjustable in a direction parallel to the direction of movement of the table. The positioning device may include a stopper mechanism for limiting reciprocation of the table at the advanced position and at a retracted position remote from the clinching die.

Is is therefore an object of the present invention to provide a positioning device which incorporates structural features to enable speedy and accurate positioning of a garment fabric with respect to a clinching die of a button setting machine.

Another object of the present invention is to provide a positioning device having a guide means which is positionally adjustable accurately and easily to thereby vary a position on a garment fabric to which a button is to be attached.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
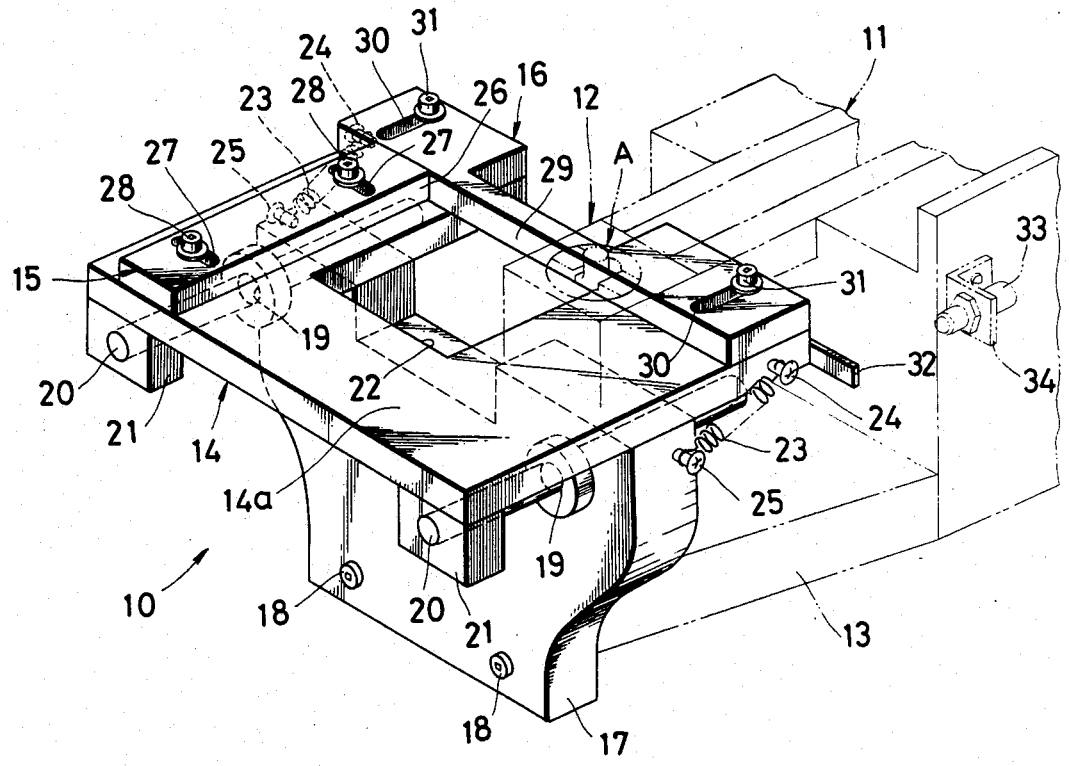
FIG. 1 is a schematic perspective view of a positioning device according to the present invention.

As shown in FIG. 1, a positioning device 10 according to the invention is built on a button setting machine 11 for positioning a garment fabric (not shown) with respect to a clinching die 12 of the machine 11. The clinching die 12 is mounted on a frame 13 of the machine 11 for supporting a button body A which constitutes one part of a button (not shown).

Figure 3:
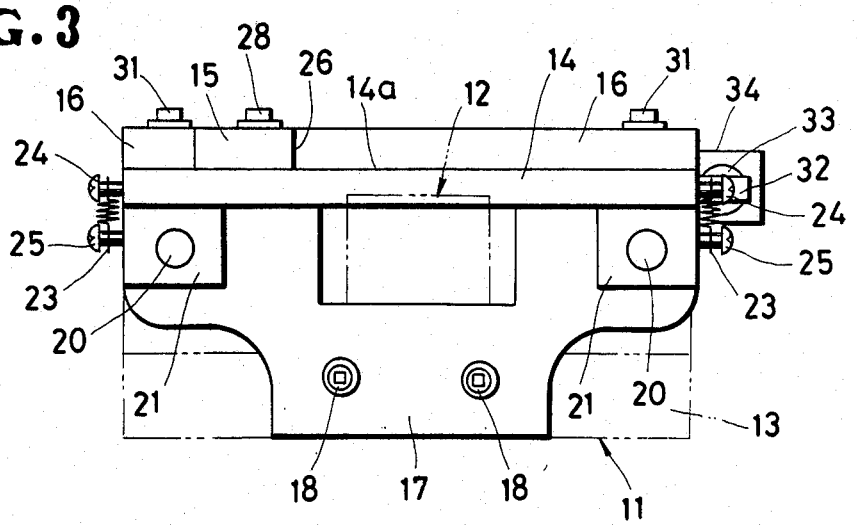
FIG. 3 is a front elevational view of FIG. 2.
Figure 4:
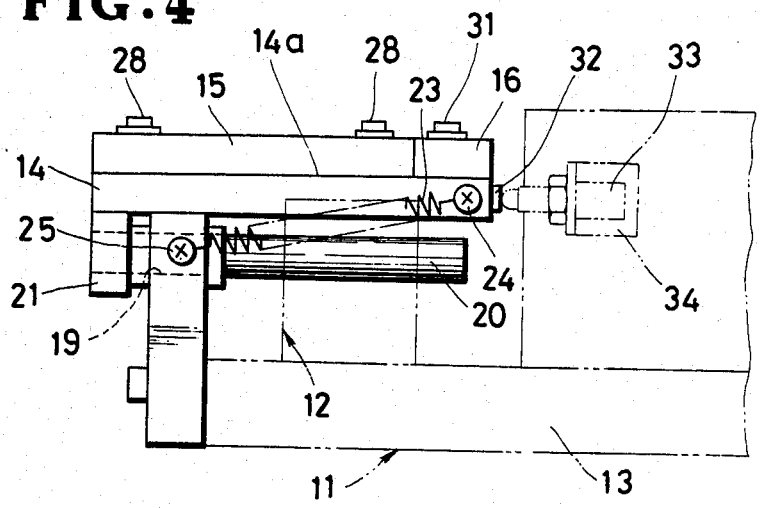
FIG. 4 is a side elevational view of FIG. 2.

The positioning device 10 generally comprises a substantially rectangular support table 14 movably mounted on the frame 13 for supporting thereon the garment fabric, and a pair of guide members 15, 16 positionally adjustably mounted on an upper surface 14*a* of the table 14 in perpendicular relation to one another, the upper surface 14*a* extending in a plane above the die 12 as shown in FIGS. 3 and 4.

The device 10 further includes a vertical support block 17 secured to the frame 13 at one side of the die 12 by means of a pair of screws 18, 18. The support block 17 has a pair of laterally spaced horizontal bores 19, 19 into which a pair of shafts 20, 20 is slidably fitted, respectively. Each of the shafts 20 is fixed at one end to a vertical lug 21 depending from a corresponding one of two adjacent corners at one end or a rear end of the rectangular support table 14. The support table 14 has a substantially rectangular recess 22 opening toward the other end or a front end of the table 14.

With this arrangement, the support table 14 is reciprocably movable between an advanced position (FIGS. 2 and 4) where the recess 22 is in registry with the clinching die 12, and a retracted position (FIG. 1) remote from the die 12. The support table 14 is normally held in the retracted position of FIG. 1 by means of a pair of tension coil springs 23, 23 each of which is connected at opposite ends to a pair of pins 24, 25 secured respectively to the support table 14 and the support block 17.

One of the guide members 15 comprises an elongated plate disposed at one side of the recess 22 and having a sidewall 26 extending parallel to the shafts 20, the sidewall 26 serving as a guide surface for one of two adjacent edges of the garment fabric. The guide plate 15 has a pair of parallel spaced oblong holes 27, 27 extending perpendicularly to the sidewall 26 and hence to the shafts 20. A pair of screws 28, 28 is threaded through the respective holes 27, 27 into the support table 14 to secure the guide plate 15 to the support table 14. Thus, the guide plate 15 is positionally adjustable in a direction perpendicular to the axis of each shaft 20 and hence to the direction of movement of the support table 14.

The other guide member 16 comprises an elongated plate disposed along a front edge of the support table 14 across the recess 22. The guide plate 16 has a sidewall 29 extending normal to the sidewall 26 of the guide plate 15, and a pair of parallel spaced oblong holes 30, 30 extending perpendicularly to the sidewall 29. The sidewall 29 serves as a guide surface for the other edge of the garment fabric. A pair of screws 31, 31 is threaded through the respective oblong holes 30, 30 into the support table 14 to thereby secure the guide plate 16 to the support table 14. Thus, the guide plate 16 is positionally adjustable in a direction parallel to the axis of each shaft 20 and hence to the movement of the support table 14.

An actuator lever or arm 32 is secured to the front end of the support table 14 and projects laterally outwardly from a side edge of the table 14. A limit switch 33 is mounted on a bracket 34 secured to the frame 13, in horizontal alignment with the lever 32. When the support table 14 is brought into the advanced position of FIG. 2, the lever 32 engages the limit switch 33 to actuate the latter to send a command signal to an actuator (not shown) for driving a clinching punch (not shown) of the machine 11 toward the die 12.

Figure 2:
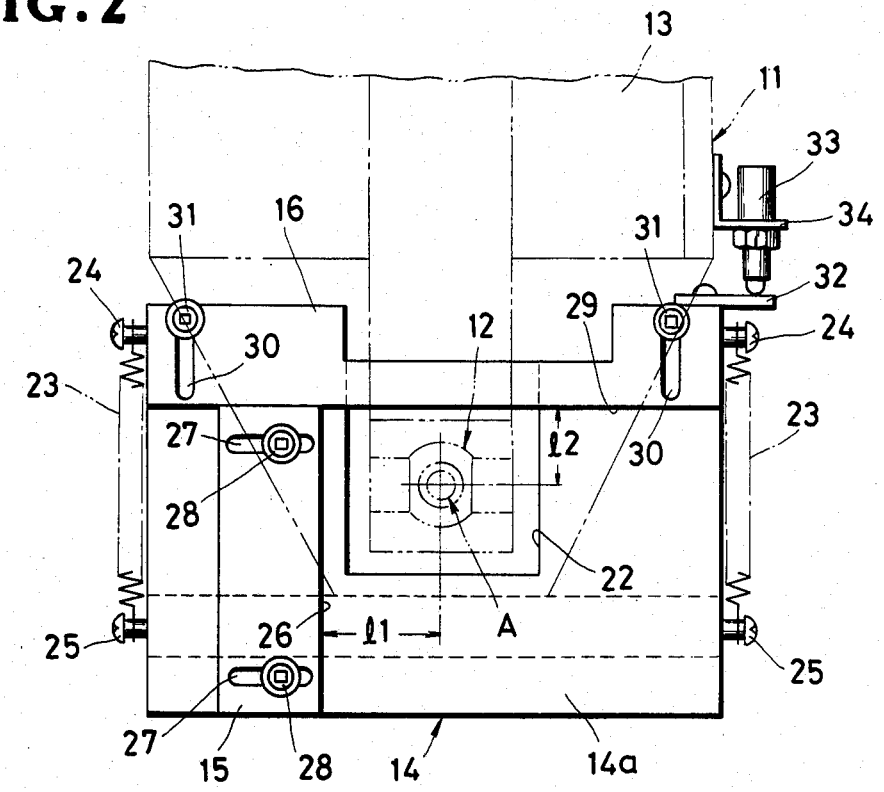
FIG. 2 is a plan view of the positioning device shown in an advanced position.

For attaching buttons to a garment fabric, at least one of the guide plates 15, 16 is adjusted in position such that the respective sidewalls 26, 29 are spaced from the central axis of the clinching die 12 by respective distances l1, l2 as shown in FIG. 2. This adjustment ensures an accurate positioning of a portion of the garment fabric with respect to the clinching die 12. Then a button body A is set on the clinching die 12 by a suitable parts supply unit (not shown). Substantially at the same time, a tack member not shown is delivered by another parts supply unit (not shown) and held below the clinching punch. Both the parts supply units are operative in timed relation to the movement of the clinching punch.

Then an operator places the garment fabric on the support table 14 while the latter is at rest in the retracted position of FIG. 1, then properly positions the garment fabric by putting two adjacent edges of the garment fabric into guided engagement with the respective sidewalls 26, 29, and finally moves the support table 14 into the advanced position of FIGS. 2 and 4 while keeping the garment fabric locked in position. Arrival of the support table 14 at the advanced position causes the actuator lever 32 to actuate the limit switch 33 to send a command signal to the actuator whereupon the punch is driven to descend toward the die 12, thereby attaching the button body and the tack in clinched condition to the garment fabric between the punch and the die 12. During that time, the punch can move through the recess 22 into coaction with the die 12.

With the positioning device 10 thus constructed, a speedy and accurate positioning of the garment fabric with respect to the die 12 can be achieved by simply putting two adjacent edges of the garment fabric into guided engagement with the sidewalls 26, 29 of the respective guide plates 15, 16. The guide plates 15, 16 are positionally adjustable in two directions crossing at a right angle to thereby enable one to vary a position on the garment fabric to which the button is to be attached.

Figure 5:
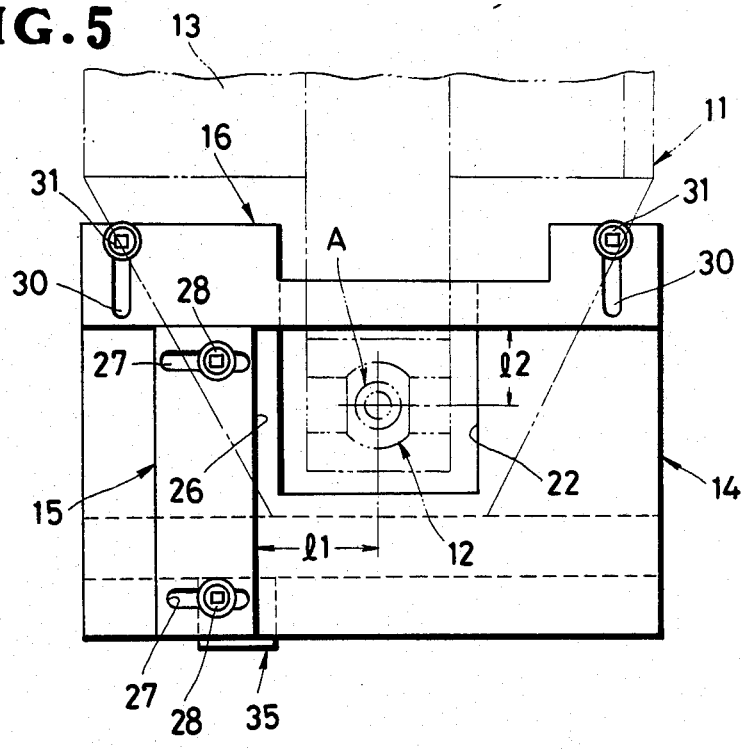
FIG. 5 is a view similar to FIG. 2, showing a modified positioning device according to the invention.
Figure 6:
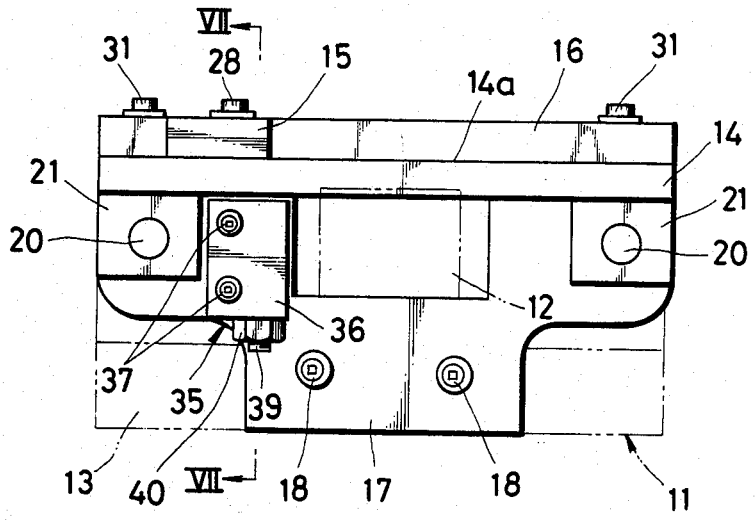
FIG. 6 is a front elevational view of FIG. 5.
Figure 7:
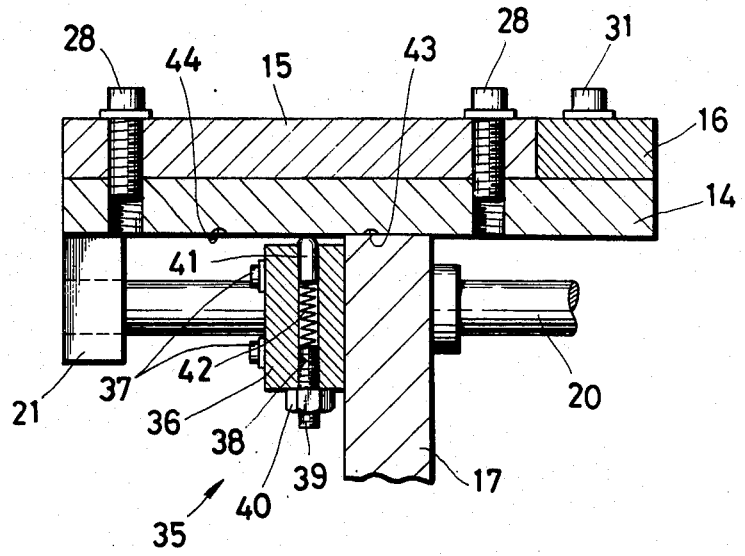
FIG. 7 is an enlarged fragmentary cross-sectional view taken along line VII—VII of FIG. 6.

FIGS. 5 to 7 show a modified positioning device according to the invention. The device is similar to the device 10 as described above but differs therefrom in that a stopper mechanism 35 is provided for limiting reciprocation of the support table 14 at an advanced position and at a retracted position.

As shown in FIG. 7, the stopper mechanism 35 includes a retainer block 36 secured to the vertical support block 17 by a pair of screws 37 and including a vertical through-hole 38. The hole 38 has a lower threaded portion into which a stud bolt 39 is threaded. A nut 40 is threaded on the bolt 39 to lock the latter in the hole 38. A stop pin 41 is slidably received in an upper non-threaded portion of the hole 38 and urged upwardly against the support table 14 by means of a compression coil spring 42 disposed in the hole 38 between the pin 41 and the bolt 39, the pin 41 having a rounded upper end portion. The support table 14 has in its underside a pair of recesses 43, 44 complementary in contour to the rounded upper end portion of the pin 41 for receiving the latter when the support table 14 is in the advanced and retracted positions. Thus, the recesses 43, 44 are spaced from one another in the direction of movement of the support table 14 by a distance which is equal to the distance between the advanced and retracted positions. The guide device has no component corresponding to the springs 23, the actuator lever 32 and the limit switch 33 of the positioning device 10 shown in FIG. 1 so that an operator is required to manually reciprocate the support table 14 while retaining the garment fabric in properly positioned condition until the stop pin 41 projects into the recesses 43, 44. After the support table 14 has arrived at the advanced position, the operator actuates a foot switch to drive the clinching punch toward the die 12.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A device for positioning a garment fabric with respect to a clinching die mounted on a frame of a buttom setting machine, said device comprising:

(a) a support table reciprocably mounted on said frame having a flat table surface extending in a horizontal plane above said clinching die for directly supporting thereon the garment fabric, said table having one end disposed adjacent to the clinching die and a recess opening toward said one end, and being reciprocably movable in the direction in which said recess opens between an advanced position where said recess is in registry with said clinching die, and a retracted position remote from said clinching die;

(b) a first guide member comprising a first elongated plate mounted on said surface of said table and disposed at one side of said recess, said first elongated guide plate extending parallel to the direction of movement of said table and having a first fabric-engaging side wall on the side closer to said recess and parallel to the adjacent edge thereof, said first guide plate being positionally adjustable in a first direction perpendicular to the direction of movement of said table for positioning the garment fabric in respect of said first direction; and (c) a second guide member comprising a second elongated plate mounted on said surface of said table in perpendicular relation to said first guide member and disposed at said one end of said support table and extending across said recess, said second guide plate extending parallel to said first direction and having a second fabric-engaging side wall facing away from said one end, said second guide plate being positionally adjustable in a second direction parallel to the direction of movement of said table for positioning the garment fabric in respect of said direction.

2. A device according to claim 1, said first elongated guide plate having a pair of first oblong holes extending parallel to said first direction, and a pair of screws extending respectively through said first oblong holes and threaded into said table, said second elongated guide plate having a pair of second oblong holes extending parallel to said second direction, and a pair of screws extending respectively through said second oblong holes and threaded into said table.

3. A device according to claim 1, including a vertical support block mounted on the frame and having at least one horizontal bore extending therethrough, a shaft slidably fitted in and extending through said bore, said support table having a vertical lug disposed on and depending from the other end of said table, said shaft being connected at one end to said lug, and at least one spring acting between said support block and said table to urge the latter into said retracted position.

4. A device according to claim 3, including a stopper mechanism for limiting reciprocation of said support table at said advanced and retracted positions.

5. A device according to claim 4, said stopper mechanism including a retainer block secured to said support block and having a vertical hole, a stop pin slidably received in said hole and having rounded upper end portion, a spring disposed in said hole to urge said stop pin against the underside of said support table, and a pair of recesses disposed in said underside of said table for receiving said upper end portion of said stop pin, said recesses being spaced in said second direction by a distance equal to the distance between said advanced and retracted positions.

* * * * *